US005696522A

United States Patent [19]

Iwama

[11] Patent Number: 5,696,522

[45] Date of Patent: Dec. 9, 1997

[54] PLASMA DRIVER CIRCUIT CAPABLE OF SURPRESSING SURGE CURRENT OF PLASMA DISPLAY CHANNEL

[75] Inventor: Jun Iwama, Kanagawa, Japan

[73] Assignee: Sony Corporation, Tokyo, Japan

[21] Appl. No.: 565,896

[22] Filed: Dec. 1, 1995

[30] Foreign Application Priority Data

Dec. 2, 1994 [JP] Japan ..... 6-329448

[51] Int. Cl.[6] ..... G09G 3/28

[52] U.S. Cl. ..... 345/60; 345/87

[58] Field of Search ..... 345/60, 62–72, 345/94, 100, 87, 41; 315/169

[56] References Cited

U.S. PATENT DOCUMENTS

| | | | |
|---|---|---|---|
| 4,242,679 | 12/1980 | Morozumi et al. | 340/765 |
| 4,250,504 | 2/1981 | Eichelberger . | |
| 4,896,149 | 1/1990 | Buzak et al. . | |
| 5,008,657 | 4/1991 | Hanson et al. | 340/766 |
| 5,045,847 | 9/1991 | Tarui et al. | 340/783 |
| 5,077,553 | 12/1991 | Buzak . | |
| 5,111,195 | 5/1992 | Fukuoka et al. | 340/811 |
| 5,349,454 | 9/1994 | Iwama | 345/60 |

FOREIGN PATENT DOCUMENTS

| | | |
|---|---|---|
| 0 044 182 | 1/1982 | European Pat. Off. . |
| 0 371 798 | 6/1990 | European Pat. Off. . |
| 0 614 166 | 9/1994 | European Pat. Off. . |

*Primary Examiner*—Richard Hjerpe
*Assistant Examiner*—David L. Lewis
*Attorney, Agent, or Firm*—Hill, Steadman & Simpson

[57] ABSTRACT

In a plasma addressed display device, rush currents flowing through the respective channels during a discharge starting time period are suppressed. A plasma addressed display device is comprised of: a plurality of data electrodes on a first substrate arranged in parallel to each other; a plurality of discharge electrodes on a second substrate each having an anode electrode and a cathode electrode arranged in parallel to each other and perpendicular to the data electrodes; a liquid crystal layer provided between the first substrate and the second substrate; a plurality of discharge channels formed between the liquid crystal layer and the second substrate, and containing ionized gas, each of the discharge channel having at least a pair of the anode electrode and the cathode electrode; a plurality of switching means for sequentially selecting the discharge channels, the switching means being provided in one-to-one correspondence with each of the discharge channels; a current supplying means for supplying a drive current to the discharge channels through the switching means corresponding to each of the discharge channels; and a control means for controlling the current supplying means in synchronization with a switching timing of the switching means, the drive current being intermittently supplied to the discharge channels by the control means.

14 Claims, 5 Drawing Sheets

PLASMA DRIVER CIRCUIT CAPABLE OF SURPRESSING SURGE CURRENT OF PLASMA DISPLAY CHANNEL

BACKGROUND OF THE INVENTION

The present invention generally relates to a plasma driver circuit for sequentially and selectively discharge-driving a plurality of discharge channels provided in plasma addressed display elements. More particularly, the present invention is directed to a technique for suppressing surge current flowing into the each channel when plasma discharging operations are commenced.

Plasma addressed display devices have been disclosed in, for instance, U.S. Pat. No. 4,896,149 to Buzak (issue date: Jan. 23, 1990), and U.S. Pat. No. 5,077,553 to Buzak (issue date: Dec. 31, 1991). The disclosures of the noted references are hereby incorporated herein. FIG. 1 schematically represents a structure of the disclosed plasma addressed display element. The plasma addressed display element of this drawing has a flat panel structure in which a display cell 101 and a plasma cell 102 are overlapped with each other via an intermediate substrate 103 made of a thin plate glass or the like. The plasma cell 102 is formed by employing a lower substrate 104, and a plurality of grooves 105 located in parallel to each other are provided on a surface of this lower substrate 104. Each of the grooves 105 is hermetically sealed by the intermediate substrate 103. Ionizable gas is filled into the grooves, and then discharge channels 106 are independently fabricated. Stripe-shaped protruded portions 107 existing between the successive grooves 105 have one function as an isolation wall for isolating the respective discharge channels 106, and have another function as a gap spacer of the lower substrate 104 with respect to the intermediate substrate 103. One pair of electrodes 108 and 109 are provided at a bottom of each groove 105, and arranged in parallel to each other. The electrodes pair may function as an anode electrode and a cathode electrode, which cause the gas filled in the discharge channel 106 to be ionized so as to produce plasma discharge therefrom. Meanwhile, the display cell 101 is equipped with a liquid crystal 111 sandwiched by the intermediate substrate 103 and an upper substrate 110. A stripe-shaped signal electrode 112 is formed on an inner surface of the upper substrate 110. This signal electrode 112 is positioned perpendicular to the above-described discharge channel 106. The signal electrodes 112 are driven in column by column, whereas the discharge channels 106 are driven in row by row, so that matrix-shaped pixels are defined at intersecting (cross) portions of both the signal electrodes 112 and the discharge channels 106.

To drive the plasma addressed display element with the above-described structure, one pair of a plasma driver circuit and a display driver circuit is used. The plasma driver circuit selectively scans the discharge channels 106 in the line sequential manner to produce plasma discharge, whereas the display driver circuit applies an image signal to the signal electrodes 112 in synchronism with the above-described line sequential scanning operation, thereby displaying a desired image. When plasma discharge is produced in the discharge channel, the inside thereof is maintained substantially at the anode potential. Under this condition, when the image signal is applied to the signal electrode 112, the image signal is written via the intermediate substrate 103 to the liquid crystal 111 of each pixel. When the plasma discharge operation is ended, the potential of the discharge channel 106 become a floating potential, so that the written image signal is held at each pixel. As a so-called "sample and hold" operation is carried out, the discharge channel 106 functions as a sampling switch, while the liquid crystal 111 functions as a sampling capacitor. In response to the image signal sampled and held, transmittance of the liquid crystal is varied and then the plasma addressed display elements are turned ON and OFF in unit of pixel.

FIG. 2 is a circuit diagram for indicating one example of the conventional plasma driver circuit. In this drawing, symbol "V" denotes a power supply voltage used to discharge a plasma display element, and symbol "Rr" shows a resistor for limiting a discharge current flowing through a discharge channel. Symbol "A" denotes an anode electrode, and symbol "K" represents a cathode electrode. A single discharge channel is constructed of one pair of these anode electrode and cathode electrode. Also, symbol "Rp" represents a pull-up resistor used to hold the potential of the cathode electrode K at the anode potential during the non-selective state. This plasma driver circuit sequentially turns ON and OFF the switches SW1, SW2, — — —, SWN to produce plasma discharge in each discharge channel. In synchronism with this operation, the image signal is supplied to the signal electrode, and the image signal is written into the pixel corresponding to the selected discharge channel.

In the case of the conventional plasma driver circuit shown in FIG. 2, the power supply voltage V must be set to a sufficiently large value to achieve discharge regardless of the effects of aging variations of plasma cells and fluctuations in the required discharge voltages of these discharge channels. However, in this case, a higher discharge voltage than the required voltage is applied to the required discharge channel whose discharge voltage is low, so that a large surge current may flow therethrough, resulting in damage to the cathode electrode and the anode electrode. As a consequence, the life of the plasma cells would be shortened.

As to the above-described problems, an additional description will now be made with reference to a timing chart of FIG. 3. When the switch SW1 is turned ON, the power supply voltage V is applied between the anode electrode A and the cathode electrode K. When the discharge operation is commenced, the voltage between the anode electrode A and the cathode electrode K is lowered to the discharge voltage Vp1 of this discharge channel. When the next switch SW2 is turned ON, the power supply voltage V is also applied between the anode electrode A and the cathode electrode K of this required discharge channel. At this time, assuming now that the discharge voltage Vp2 of this discharge channel is lower than the discharge voltage Vp1, such a higher discharge voltage than the required discharge voltage is applied to the relevant discharge channel. Therefore, a large surge current would flow through this discharge channel cell, which could damage the anode electrode and the cathode electrode.

SUMMARY OF THE INVENTION

The present invention has been made in an attempt to solve the above-described problems, and therefore, has an object to provide a plasma driver circuit capable of suppressing such a surge current. To achieve the above-described object, according to an aspect of the present invention, a driver circuit for a display device is comprised of:

a plurality of discharge channels having a plurality of discharge electrodes;

a plurality of switching means for sequentially selecting the discharge channels, the switching means being provided in one-to-one correspondence with each of the discharge channels;

a current supplying means for supplying a drive current to the discharge channels through the switching means corresponding to each of the discharge channels; and a control means for controlling the current supplying means in synchronization with a switching timing of the switching means, the drive current being intermittently supplied to the discharge channels by the control means.

According to another aspect of the present invention, a plasma addressed display device is comprised of:

a plurality of data electrodes on a first substrate arranged in parallel to each other;

a plurality of discharge electrodes on a second substrate each having an anode electrodes and a cathode electrodes arranged in parallel to each other and perpendicular to the data electrodes;

a liquid crystal layer provided between the first substrate and the second substrate;

a plurality of discharge channels formed between the liquid crystal layer and the second substrate, and containing ionized gas each of the discharge channel having at least a pair of the anode electrode and the cathode electrode;

a plurality of switching means for sequentially selecting the discharge channels, the switching means being provided in one-to-one correspondence with each of the discharge channels;

a current supplying means for supplying a drive current to the discharge channels through the switching means corresponding to each of the discharge channels; and a control means for controlling the current supplying means in synchronization with a switching timing of the switching means, the drive current being intermittently supplied to the discharge channels by the control means.

In accordance with the present invention, a plurality of switches are sequentially turned ON/OFF so as to select the respective discharge channels. In synchronism with the switching operation, the pulse-form drive current is supplied to the selected discharge channel. The control circuit controls the pulse current waveform, so that the discharging drive voltages suitable for the respective discharge channels are applied to the relevant discharge channels. As a consequence, since the applied voltage between the anode electrode and the cathode electrode is merely increased up to the required discharge voltage of the relevant discharge channel irrespective of the external power supply voltage, the unnecessary surge current can be suppressed. Therefore, no damage is done to the anode electrode or the cathode electrode, and also the stable discharge operation can be maintained for a long time period. The power supply voltage can also be easily set without coping with the variations among the lines or the aged deteriorations in characterics of the discharge channels. In particular, since the current waveform is stepwise controlled corresponding to the discharge operations in being commenced and in being continued, the voltage between the anode electrode and the cathode electrode are able to quickly reach to the discharge voltage. Similarly, when the constant biasing current is supplied even during the non-selective condition, the voltage between the anode electrode and the cathode electrode is able to quickly reach to the discharge voltage during the selective condition. As previously explained, by changing the plasma drive circuit from the conventional switch system into the current control system, the long lifetime of the discharge channel and also the stable discharge operation can be achieved.

BRIEF DESCRIPTION OF THE DRAWINGS

The above-described object and other objects, and also features of the present invention will become apparent from the detailed descriptions to be read in conjunction with the accompanying drawings, in which.

DETAILED DESCRIPTION OF THE PREFERRED EMBODIMENTS

Referring now to drawings, plasma driver circuits according to preferred embodiments of the present invention will be described in detail.

Figure 4:
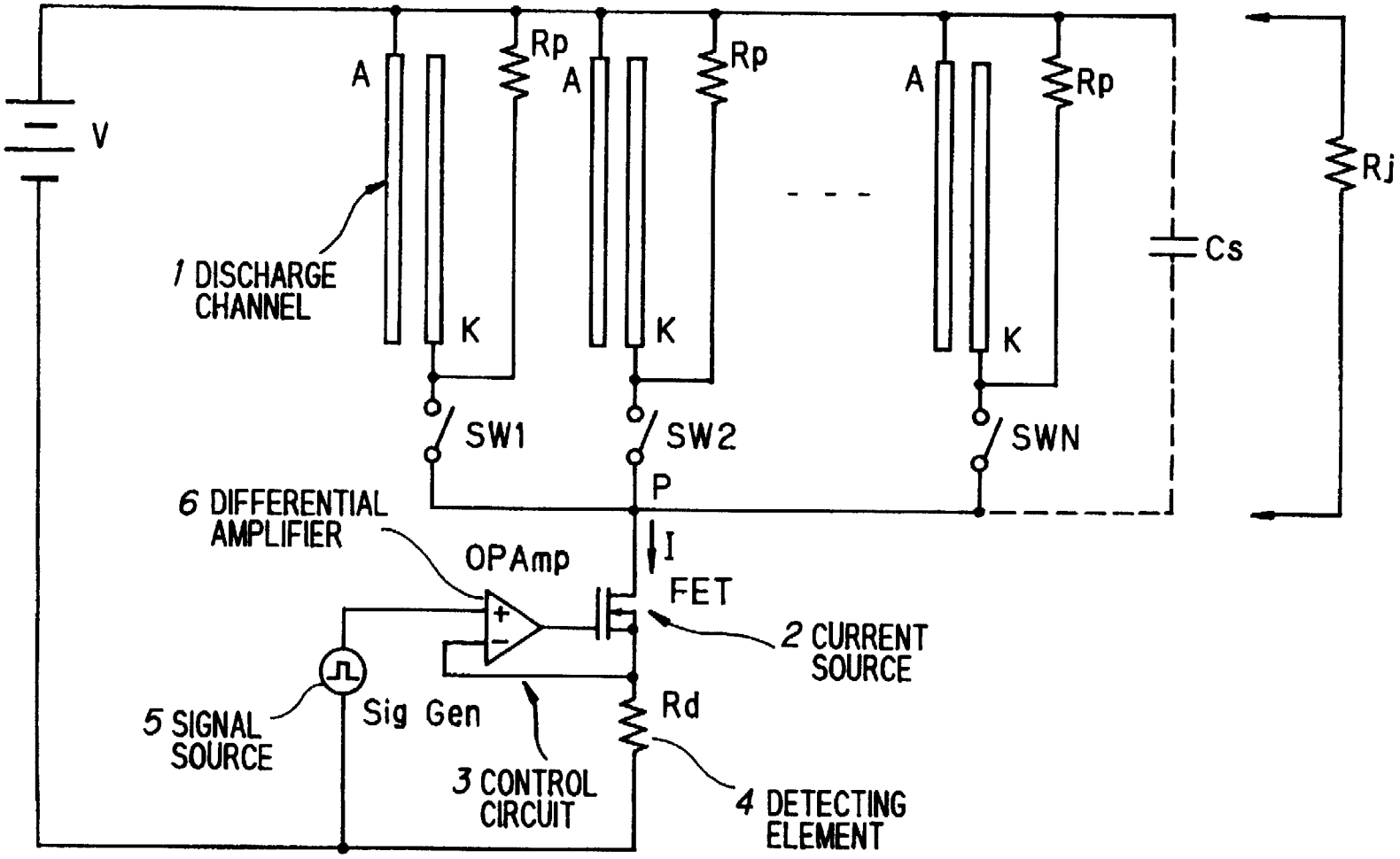
FIG. 4 is a circuit diagram for showing a plasma driver circuit according to an embodiment of the present invention.

FIG. 4 is a circuit diagram of a plasma driver circuit according to an embodiment of the present invention. As shown in this drawing, this plasma driver circuit is to sequentially and selectively drive a plurality of discharge channels 1 provided in plasma addressed display elements. Each of these discharge channels is constructed of one pair of an anode electrode "A" and a cathode electrode "K". A plurality of switches SW1, SW2, — — —, SWN are employed correspondence to the respective discharge channels 1. These plural switches are sequentially turned ON/OFF to thereby select the respective discharge channels 1. A current source 2 is commonly connected via the switches SW1, SW2, — — —, SWN to the cathode electrodes K of the respective discharge channels 1 so as to supply a predetermined drive current 2 thereto. In this embodiment, this current source 2 is constructed by employing a field-effect transistor (FET) whose drain is connected to a common node "P".

As the featured aspect of the present invention, there is provided a control circuit 3. In synchronism with the switching operations of the above-explained plural switches SW1, SW2, — — —, SWN, this control circuit 3 controls the current source 2 to intermittently output a drive current I. This control circuit 3 further controls the waveform of this drive current I to apply voltages suitable for driving the respective discharge channels 1. In this embodiment, the control circuit 3 is arranged with a sensing element 4 for producing a sensing signal corresponding to the drive current I, a signal source 5 for producing a waveform signal corresponding to the switching operation of the switch SW, and a differential amplifier 6 for controlling the current output of the current source 2 in accordance with a difference between the sensing signal and the waveform signal. The sensing element 4 is comprised of a sensing resistor Rd connected to the source of the FET which constitutes the current source 2. The signal source 5 is arranged with a signal generator (Sig Gen) for generating a rectangular pulse waveform signal. Furthermore, the differential amplifier 6 is arranged with an operational amplifier (OP Amp). The negative input terminal of this operational amplifier has the above-explained sensing signal applied thereto the positive input terminal has the waveform signal applied thereto, and the output terminal is connected to the gate electrode of the FET.

Figure 1:
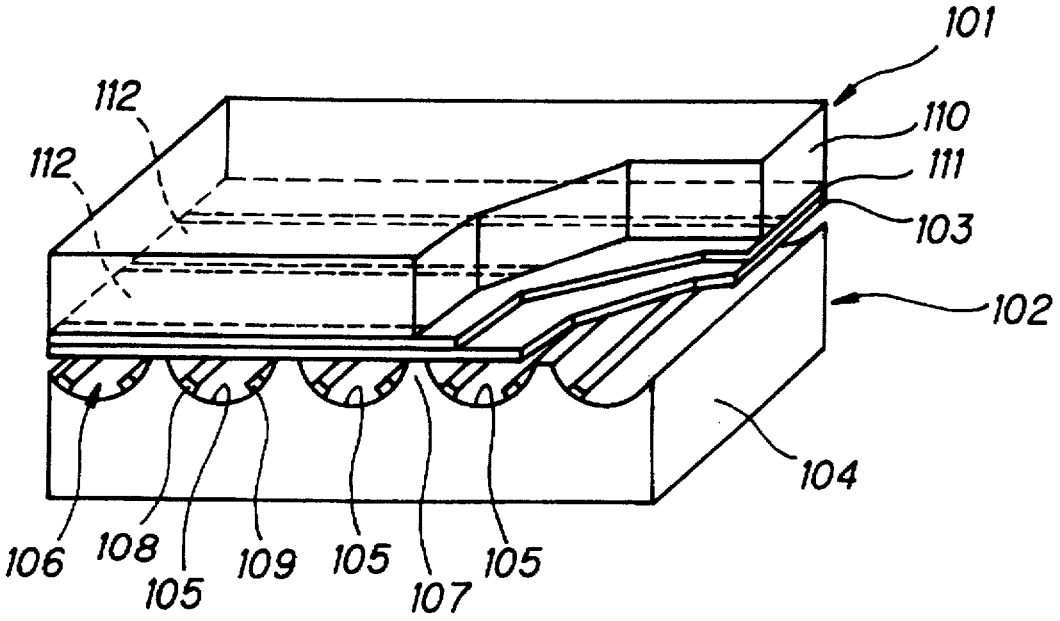
FIG. 1 PRIOR ART
FIG. 1 is a perspective view for showing a general structure of a plasma addressed display element.
Figure 2:
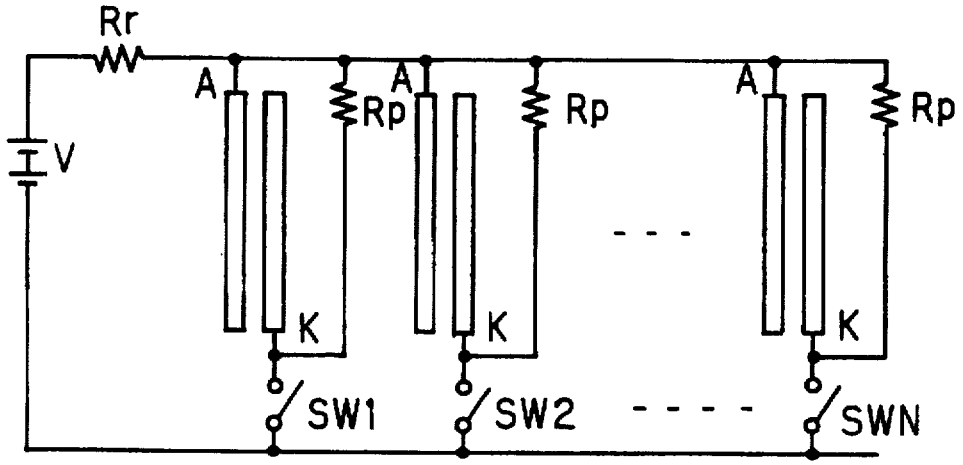
FIG. 2 PRIOR ART
FIG. 2 is a circuit diagram for representing one example of the conventional plasma driver circuit.
Figure 3:
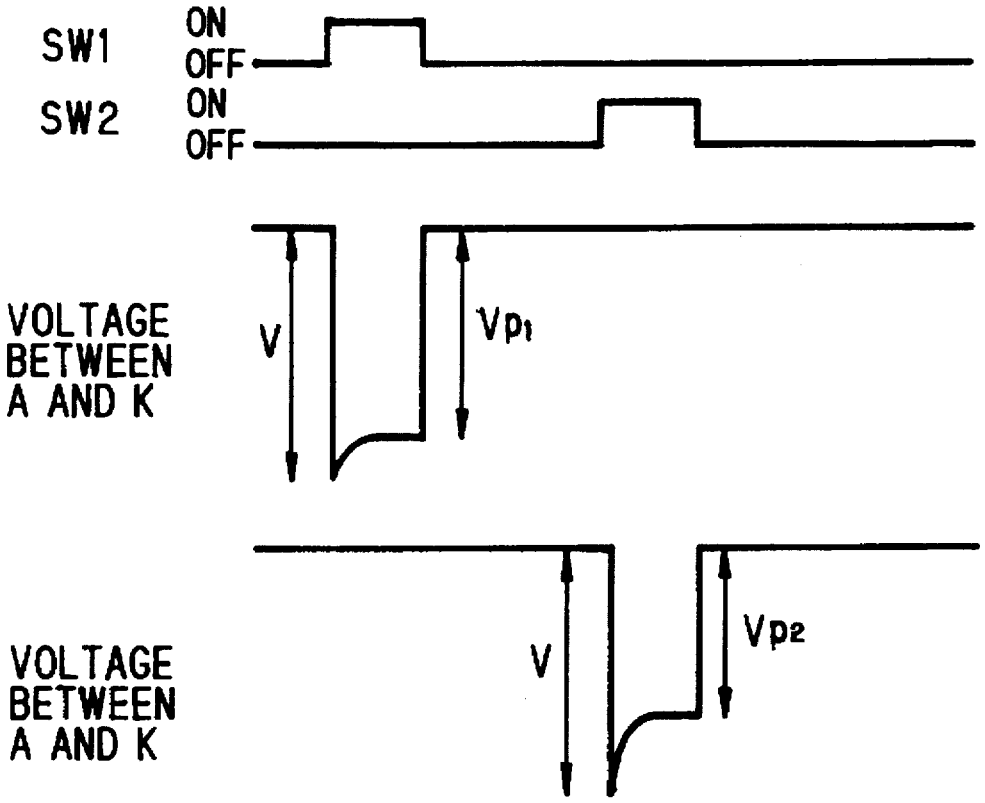
FIG. 3 PRIOR ART
FIG. 3 indicates a waveform chart used to explain operations of the conventional plasma driver circuit shown in FIG. 2.

It should be noted that symbol "V" shown in the circuit of FIG. 1 designates a power supply voltage to be applied to the plasma cell and the plasma drive circuit, and symbol "Rp" represents a pull-up resistor used to maintain the potential of the cathode electrode K at the anode potential during the non-selective state. Also, signal "Cs" represents an equivalent internal capacitance of a plasma cell, and symbol "Rj" denotes a bias resistor.

Figure 5:
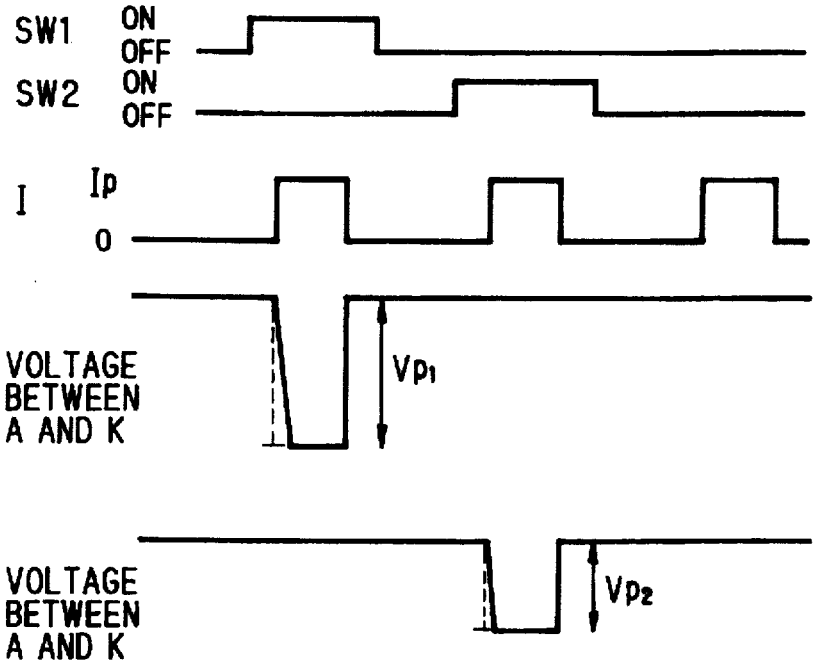
FIG. 5 represents a waveform chart used to explain operations of the plasma driver circuit shown in FIG. 4.

Referring now to a timing chart of FIG. 5, operations of the plasma driver circuit shown in FIG. 4 will be described in detail. As represented in the drawing, the switches SW1, SW2, — — —, SWN are sequentially turned ON/OFF. In synchronism with this switching operation, the current source 2 intermittently outputs the pulse-form drive current I. The control circuit 3 controls the current waveform so as to form a rectangular pulse shape. The control circuit 3 controls the height of this pulse-shaped current wave to be set to "Ip". When the current from the current source is set to Ip under ON-state of the switch SW1, the voltage between the anode electrode A and the cathode electrode K starts to be decreased in accordance with the inclination determined by Ip and the internal capacitance Cs of the plasma cell, and becomes stable at the discharge voltage Vp1. Next, the potential at the cathode electrode is returned to the anode potential by reducing the drive current to zero. Subsequently, when the switch SW2 is brought into the ON state, a pulse-form current is similarly applied, and the voltage between the anode electrode A and the cathode electrode K starts to be decreased. This voltage between A and K is similarly lowered for the discharge voltage Vp2 being low, and becomes stable at the required discharge voltage. As easily understood from the foregoing descriptions, the control circuit 3 controls the drive current I after the rising operation of the respective discharge channels 1, so that the required discharge voltages are maintained. For this purpose, the control circuit 3 includes the sensing element 4, the signal source 5, and the differential amplifier 6 for maintaining the drive current to have a described waveform by the feedback control.

Figure 6:
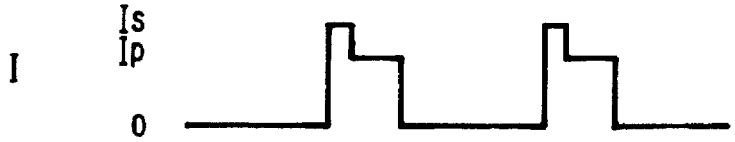
FIG. 6 is a waveform chart for showing another example of the drive current waveform.

FIG. 6 is a waveform chart for showing another example of the drive current I. This current waveform may be freely set by the signal with the waveform outputted from the signal source 5 shown in FIG. 4. In this case, the current waveform is set stepwise corresponding to operations when the discharge cell starts to be driven and when the discharge cell is continuously driven. In other words, a relatively large current Is may flow when the discharge cell stars to be driven, so that the internal capacitance Cs of the plasma cell is quickly charged. As a result, the voltage between A and K quickly reaches the required discharge voltage Vp. Thereafter, this relatively large current is changed into a relatively small current Ip when the discharge drive operation is maintained, so that the discharge state may be maintained.

Figure 7:
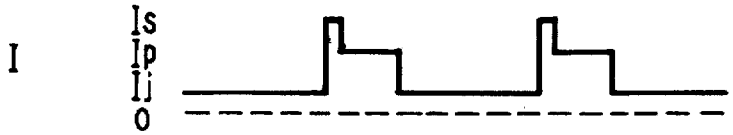
FIG. 7 is a waveform chart for showing a further example of the drive current waveform.

FIG. 7 is a waveform chart for indicating a further another example of the drive current I. This current waveform is basically similar to the current waveform shown in FIG. 6. In this case, however, a constant bias current Ij may be supplied even during the non-selective state. In the case of the current waveform shown in FIG. 5 or FIG. 6, when the discharge operation is ended, the potential at the common node P is increased up to the anode potential by the effect of the pull-up resistor Rp. Thereafter, to commence the next discharge operation, the internal capacitance Cs is again charged and then the potential at the common node P must be decreased. As described above, as to the current waveforms of FIG. 5 and FIG. 6, the internal capacitance Cs of the plasma cell must be repeatedly charged and discharged. To avoid this charge/discharge operation, in the case of FIG. 7, a constant bias current Ij is supplied during the non-selective condition in order to maintain the potential of the common node P at the intermediate level. This intermediate level is set by providing the bias resistor Rj. For example, if this intermediate level is set to a level approximately equal to the extinction voltage, then the excessive charge/discharge operations of the internal capacitance Cs are no longer needed to be repeated.

Figure 8:
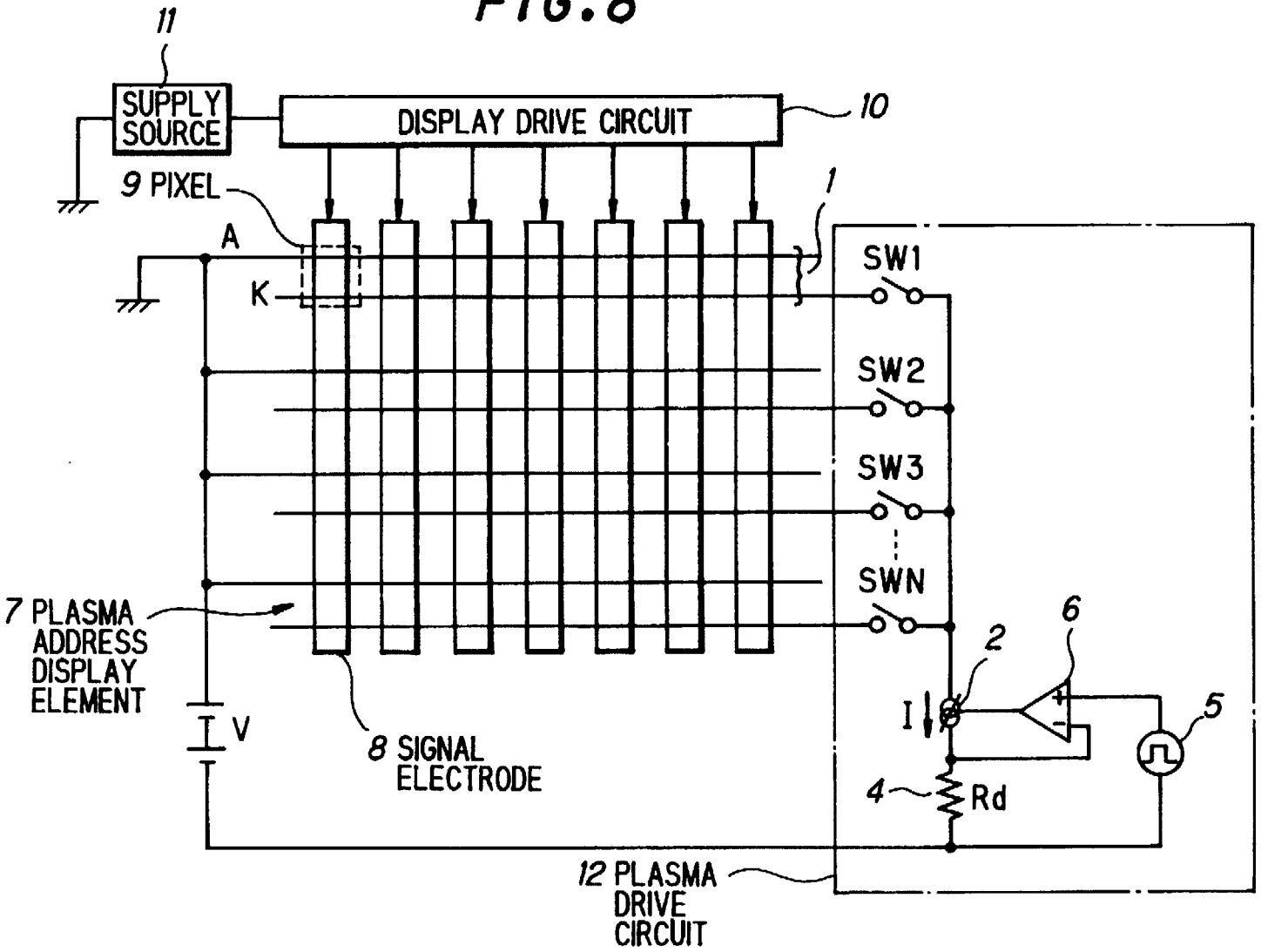
FIG. 8 is a diagram schematically showing an overall driver circuit arrangement of the plasma addressed display element, according to the present invention.

FIG. 8 is a schematic block diagram for representing an overall driver circuit arrangement of a plasma addressed display element. The plasma addressed display element 7 corresponds to the panel structure shown in FIG. 1, and is constructed of a display cell and a plasma cell. The display cell is equipped with a column-shaped signal electrode 8, whereas the plasma cell is equipped with a row-shaped discharge channel 1. As described above, a single discharge channel 1 is constructed of one pair of an anode electrode A and a cathode electrode K. A pixel 9 is defined at an intersecting portion between the signal electrode 8 and the discharge channel 1. A display drive circuit (column resistor) 10 is connected to each of the signal electrodes 8. A video data supply source 11 is connected to this display drive circuit 10. Meanwhile, a plasma drive circuit 12 is connected to each of the discharge channels 1. This plasma drive circuit 12 corresponds to a composition as shown in FIG. 4. An image signal for each horizontal line portion is transferred from the video data supply source 11 to the display drive circuit (column resistor) 10, and then is supplied to the signal electrodes 8. In synchronism with this image signal transfer operation, the plasma discharge is produced for each line, and the discharge channels 1 are line-sequentially brought into the selective condition. As a consequence, the image signal is written into the pixel 9 positioned on the selected line. When the plasma discharge is ended, this selected line is brought into the non-selective condition with the written image signal being maintained until the subsequent selective condition. Here, the plasma drive circuit 12 sequentially supplies proper drive currents to each discharge channels 1 by way of the switches SW1, SW2, — — —, SWN, the current source 2, and the control circuit (4, 5, 6) and so on.

While the present invention has been described in detail, the plasma drive circuit is changed from the conventional switch system into the analog current control system. As a consequence, since the applied voltage between the anode electrode and the cathode electrode is merely increased up to the discharge voltage of the relevant discharge channel irrespective of the external power supply voltage, the unnecessary surge current can be suppressed. Therefore, no damage is given to the anode electrode or the cathode electrode, and also the stable discharge operation can be maintained for a long time period. Since no compensation of the variations among the lines or the aged deteriorations in characteristics of the discharge channels is necessary, the power supply voltage can be easily set compared with the prior art.

What is claimed is:

1. A driver circuit for a plasma addressed display device, comprising:

a plurality of plasma discharge channels having a plurality of plasma discharge electrodes;

a plurality of switching means for sequentially selecting said plasma discharge channels, said switching means being provided in one-to-one correspondence with each of said plasma discharge channels;

a current supplying means for supplying a plasma drive current to said plasma discharge channels through said switching means corresponding to each of said plasma discharge channels; and a control means for controlling said current supplying means in synchronization with a switching timing of said switching means to suppress surge current significantly above a current required for plasma discharge in said plasma discharge channels, said plasma drive current being intermittently supplied to said plasma discharge channels by said control means.

2. A driver circuit for a display device as recited in claim 1, wherein said control means comprises a sensing element for producing a sensing signal responsive to said drive current, said sensing signal determining an level of said plasma drive current.

3. A driver circuit for a display device as recited in claim 2, wherein said control means further comprises a signal generating means for generating a waveform signal in response to said switching timing.

4. A driver circuit for a display device as recited in claim 3, wherein said control means further comprises a differential amplifier for controlling said plasma drive current on the basis of a difference between said sensing signal and said waveform signal.

5. A driver circuit for a display device as recited in claim 1, wherein each of said plasma discharge electrodes comprises an anode electrode and a cathode electrodes, and said current supplying means is connected with each of said cathode electrodes.

6. A driver circuit for a display device as recited in claim 1, wherein said control means controls said current supplying means to supply said drive current with a waveform of a pulse with a portion following a rising edge thereof being larger than the other portion.

7. A driver circuit for a display device as recited in claim 1, wherein said control means controls said current supplying means to supply a biasing current of a prescribed value to said plasma discharge channels which are under non-selected state.

8. A plasma addressed display device, comprising:

a plurality of data electrodes on a first substrate arranged in parallel to each other;

a plurality of plasma discharge electrodes on a second substrate each having an anode electrode and a cathode electrode arranged in parallel to each other and perpendicular to said data electrodes;

a liquid crystal layer provided between said first substrate and said second substrate;

a plurality of plasma discharge channels formed between said liquid crystal layer and said second substrate, and containing ionized gas, each of said plasma discharge channels having at least a pair of said anode electrode and said cathode electrode;

a plurality of switching means for sequentially selecting said plasma discharge channels, said switching means being provided in one-to-one correspondence with each of said plasma discharge channels;

a current supplying means for supplying a plasma drive current to said plasma discharge channels through the switching means corresponding to each of said plasma discharge channels, said plasma drive current causing a plasma discharge between said anode electrode and said cathode electrode of said plasma discharge channel; and a control means for controlling said current supplying means in synchronization with a switching timing of said switching means to vary said plasma drive current depending on a required plasma discharge voltage for corresponding ones of said plasma discharge channels, said drive current being intermittently supplied to said plasma discharge channels by the control means.

9. A plasma addressed display device as recited in claim 8, wherein said control means comprises a sensing element for producing a sensing signal responsive to said drive current, said sensing signal determining a level of said plasma drive current.

10. A plasma addressed display device as recited in claim 9, wherein said control means further comprises a signal generating means for generating a waveform signal in response to said switching timing.

11. A plasma addressed display device is recited in claim 10, wherein said control means further comprises a differential amplifier for controlling said plasma drive current on the basis of a difference between said sensing signal and said waveform signal.

12. A plasma addressed display device as recited in claim 8, wherein said current supplying means is connected with each of said cathode electrodes.

13. A plasma addressed display device as recited in claim 8, wherein said control means controls said current supplying means to supply said plasma drive current with a waveform of a pulse with a portion following a rising edge thereof being larger than the other portion.

14. A plasma addressed display device as recited in claim 8, wherein said control means controls said current supplying means to supply a biasing current of a prescribed value to said plasma discharge channels which are under non-selected state.

* * * * *